US005235304A

United States Patent [19]

Ohtake et al.

[11] Patent Number: 5,235,304

[45] Date of Patent: Aug. 10, 1993

[54] DUST PREVENTING DEVICE FOR ELECTROMAGNETIC CONTACTOR

[75] Inventors: Shigeaki Ohtake; Takato Hirota; Chuuji Nozukidaira, all of Kawasaki, Japan

[73] Assignee: Fuji Electric Co., Ltd., Kawasaki, Japan

[21] Appl. No.: 885,812

[22] Filed: May 20, 1992

[30] Foreign Application Priority Data

Jun. 20, 1991 [JP] Japan ..... 3-176190

[51] Int. Cl.[5] ..... H01H 67/02

[52] U.S. Cl. ..... 335/132; 335/202; 335/201

[58] Field of Search ..... 335/131-132, 335/201, 202; 200/144 R, 147 R

[56] References Cited

U.S. PATENT DOCUMENTS 4,506,243 3/1985 Okado et al. ..... 335/132
5,081,436 1/1992 Nishi et al. ..... 335/131
5,103,198 4/1992 Morel et al. ..... 335/6

FOREIGN PATENT DOCUMENTS 60-21122 2/1985 Japan .

*Primary Examiner*—Lincoln Donovan
*Attorney, Agent, or Firm*—Kanesaka and Takeuchi

[57] ABSTRACT

A dust preventing device for an electromagnetic contactor prevents foreign matters accumulated on a foreign matter preventing wall from slipping off the wall due to vibrations of electromagnetic contactor. In a case where an arc extinguishing chamber cover is disposed to cover a fixed contact and a movable contact, and includes a foreign matter preventing wall provided under a gas discharging opening formed on the cover, the foreign matter preventing wall is formed with ribs provided therearound in a shape of an embankment. Therefore, foreign matters having entered through the gas discharging opening can be positively trapped in a hollow portion surrounded by ribs, so that the foreign matters do not fall into the electromagnetic contactor from the foreign matter preventing wall due to vibrations of the contactor.

4 Claims, 4 Drawing Sheets

DUST PREVENTING DEVICE FOR ELECTROMAGNETIC CONTACTOR

BACKGROUND OF THE INVENTION AND RELATED ART STATEMENT

The present invention relates to a dust preventing device for an electromagnetic contactor, wherein foreign matters are prevented from entering into an electromagnetic contactor through a gas discharging opening.

FIGS. 7 through 9 show a structure of a conventional dust preventing device, wherein FIG. 7 is a vertical section view of a principal part around a contact portion of the electromagnetic contactor; FIG. 8 is an enlarged perspective view of a principal part of an arc extinguishing chamber cover; and FIG. 9 is a perspective view of an outer appearance of the electromagnetic contactor shown in FIG. 7 when installed.

In these figures, reference numeral 1 designates a fixed contact, and 2 represents a movable contact which is attached to and detached from the fixed contact 1. The contact 1 is fixed to an upper case 3, while the movable contact 2 is supported by a movable contact support 4 which slides in the horizontal direction, in FIG. 7, in the upper case 3 and is urged by a contact spring 5. The fixed contact 1 and the movable contact 2 have a fixed contact point 1*a* and a movable contact point 2*a*, respectively, in respective opposing surfaces. The fixed contact 1 includes a terminal screw 6 at its end.

The movable contact support 4 moves together with a movable core (not shown), so that when the movable core is sucked, the movable contact 4 is moved in the right horizontal direction in FIG. 7 to thereby cause the movable contact point 2*a* to contact the fixed contact point 1*a*. Reference numeral 7 represents an arc extinguishing chamber cover to cover a switching space. Arc extinguishing partitions 9 extend for the respective parts from a sealing wall 8 for covering top portions of the movable contact support 4. The arc extinguishing partition 9 includes a gas discharge opening 10 in a rectangular shape. Reference numeral 11 designates a foreign matter preventing wall which is provided in the electromagnetic contactor so that foreign matters do not enter thereinto through the gas discharging opening. The foreign matter preventing wall 11 is formed in a rectangular shape to coincide with the shape of the gas discharging opening 10 in a mounted posture as shown in FIG. 8. Further, the foreign matter preventing wall 11 is formed parallel to the arc extinguishing partition 9 with an appropriate space therebetween, and integrally with the sealing wall 8.

With such a structure of the conventional extinguishing contactor, when foreign matters enter into the gas discharging opening 10, and if foreign matters are larger than a space between the arc extinguishing partition 9 and the foreign matter preventing wall 11, such foreign matters are prevented from entering into the extinguishing contactor. On the other hand, if foreign matters are smaller than the space, such foreign matters cannot be prevented from entering thereinto. More specifically, in case foreign matters with insulating ability enter between the fixed contact 1 and the movable contact 2, there may occur a difficulty in conductivity, while when foreign matters with magnetism enter into a space between the fixed contact 1 and the movable contact 2, the magnetic foreign matters are sucked by magnetism of an electromagnet and adhered to the contact surfaces, which results in a problem such as buzzing.

Accordingly, an object of the present invention is to obviate the above problems and to provide a dust preventing device for an electromagnetic contactor, wherein prevention of foreign matters from entering or invading into the space between the arc extinguishing partition and the foreign matter preventing wall is effectively improved.

SUMMARY OF THE INVENTION

In order to achieve the above objects in the present invention, ribs are disposed in an embankment shape around the foreign matter, preventing wall on the side opposite to the arc extinguishing partition.

The ribs may be extended to the arc extinguishing partition like side walls except a portion.

Further, the foreign matter preventing, wall, may include, on the side opposed to the arc extinguishing partition, an inclined surface descending toward the ceiling wall of the arc extinguishing chamber cover, and an opening formed on the ceiling wall adjacent to the edge of said inclined surface of the foreign matter preventing wall, so that foreign matters entering through the gas discharging opening can be discharged to the outside through the opening along the inclined surface.

Since the ribs are provided around the foreign matter preventing wall to thereby form a hollow space on the side opposite to the arc extinguishing partition, foreign matters having entered inside through the gas discharging opening are trapped in the hollow space so that these foreign matters can be prevented from slipping off the foreign matter preventing wall due to switching vibrations of the electromagnetic contactor. In this case, in case the ribs are provided around the foreign matter preventing wall except a portion through which gas passes to extend to the arc extinguishing partition like side walls, the foreign matters can be more positively prevented from slipping off the foreign matter preventing wall.

Further, in case the foreign matter preventing wall on the side surface opposite to the arc extinguishing partition is formed with an inclination descending toward the ceiling wall of the arc extinguishing chamber cover, and a through hole is formed on the ceiling wall adjacent to the edge of said inclined surface, foreign matters having entered through the gas discharging opening can be received in the hollow space of the foreign matter preventing wall, and discharged to the outside from the through hole by sliding down along said inclined surface.

DETAILED DESCRIPTION OF PREFERRED EMBODIMENTS

Figure 1:
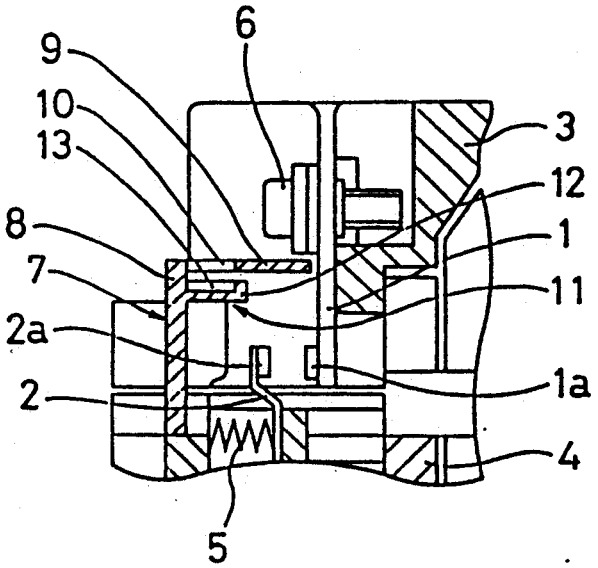
FIG. 1 is a vertical section view showing a principal part of a switching portion of an electromagnetic contactor of a first embodiment of the present invention.

Referring to FIGS. 1 through 6, embodiments of the present invention will be explained, wherein the same reference numerals are used for parts corresponding to conventional ones, and explanations for the same parts as conventional ones will be omitted.

Figure 2:
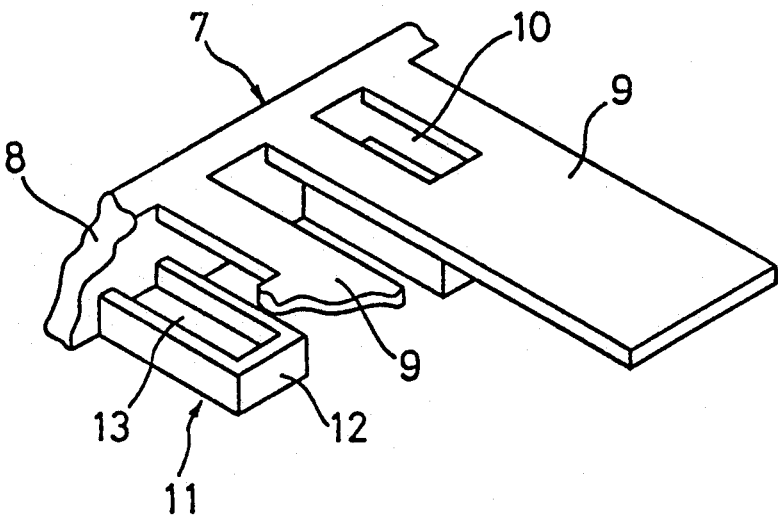
FIG. 2 is an enlarged perspective view of a principal part of an arc extinguishing chamber cover in FIG. 1.

FIGS. 1 and 2 show a first embodiment, wherein FIG. 1 is a vertical section view showing a principal part of a contact portion of an electromagnetic contactor, and FIG. 2 is an enlarged perspective view of an arc extinguishing chamber cover.

In the first embodiment, what are different from the conventional one are ribs 12 around a foreign, matter preventing wall on the side opposite to an arc extinguishing partition 9, except for the side of a ceiling wall 8 of an arc extinguishing chamber cover 7, and a hollow portion 13 is formed therein. The size of the hollow portion 13 is preferably the same as or larger than that of a gas discharging opening 10.

When a dust preventing device is constructed as described above, foreign matters having entered inside through the gas discharge opening 10 are trapped in the hollow portion 13, and prevented by the ribs 12 from slipping off the periphery of the foreign matter preventing wall 11, so that small foreign matters can be easily trapped therein and do not enter into the electromagnetic contactor.

Figure 3:
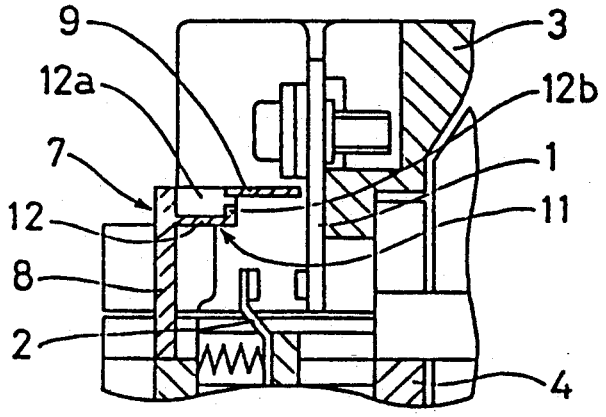
FIG. 3 is a vertical section view showing a principal part of the switching portion of the electromagnetic contactor of a second embodiment of the present invention.
Figure 4:
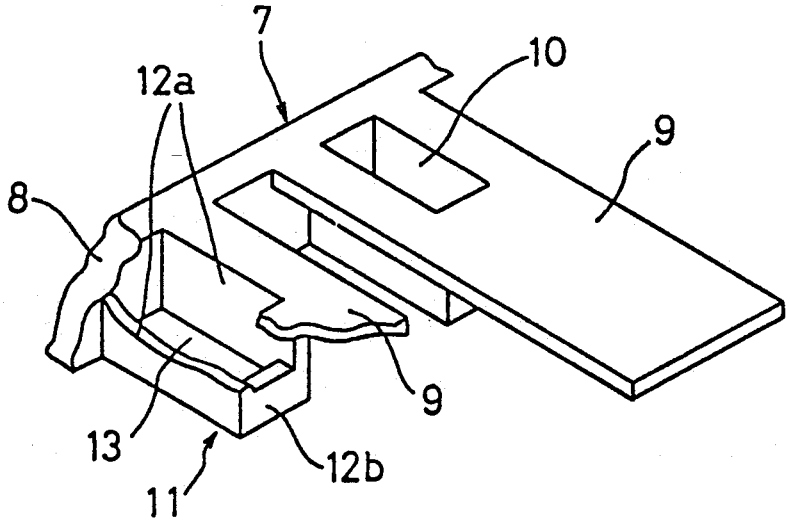
FIG. 4 is an enlarged perspective view of a principal part of the arc extinguishing chamber cover in FIG. 3.

FIGS. 3 and 4 show a second embodiment of the present invention. In the second embodiment, both side portions 12*a* among the ribs 12 in the first embodiment are extended to the arc extinguishing partition 9 like side walls, so that spaces between the arc extinguishing partition 9 and the foreign matter preventing wall 11 are completely closed. A rib 12*b* among the ribs 12 in front of the wall 11, however, is formed in an embankment shape to remain as a gas path. The gas path may be formed in any one of the side portions 12*a*.

With a construction as described above, except for the front rib portion as a gas path, the space between the arc extinguishing partition 9 and foreign matter preventing wall 11 is completely closed, so that foreign matters can be positively prevented from slipping off the hollow portion 13 and entering into the electromagnetic contactor.

Figure 5:
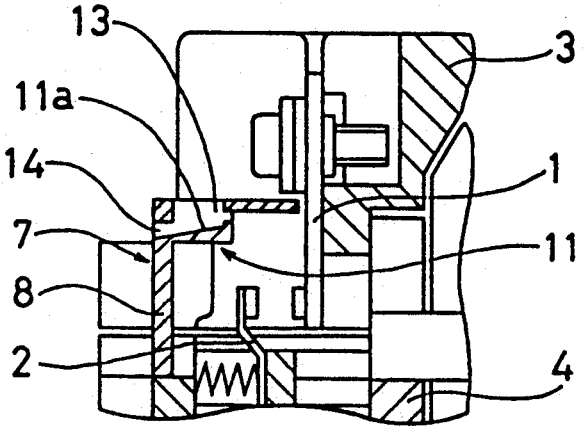
FIG. 5 is a vertical section view showing a principal part of the switching portion of the electromagnetic contactor of a third embodiment of the present invention.
Figure 6:
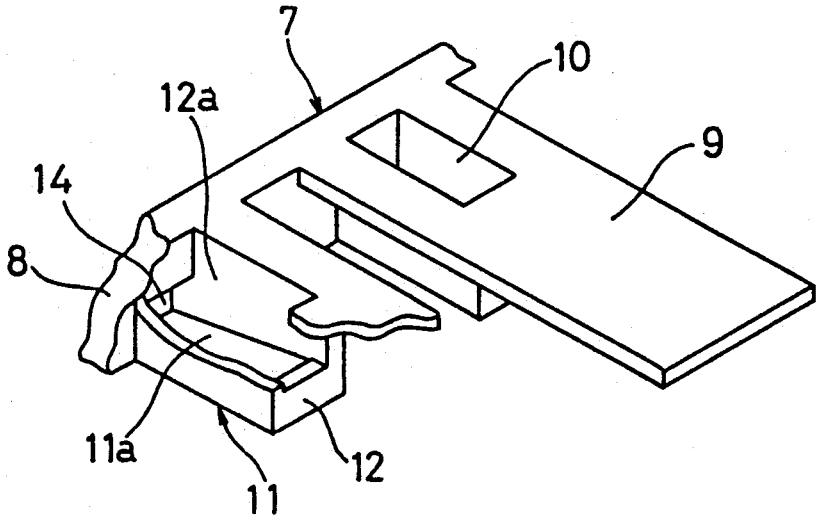
FIG. 6 is an enlarged perspective view showing a principal part of the arc extinguishing chamber cover in FIG. 5.
Figure 7:
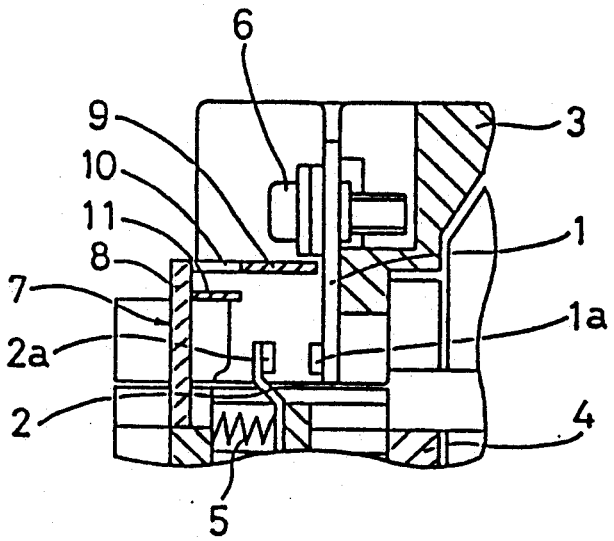
Fig. 7 (Prior Art)
FIG. 7 is a vertical section view showing a principal part of a switching portion of a conventional electromagnetic contactor.
Figure 8:
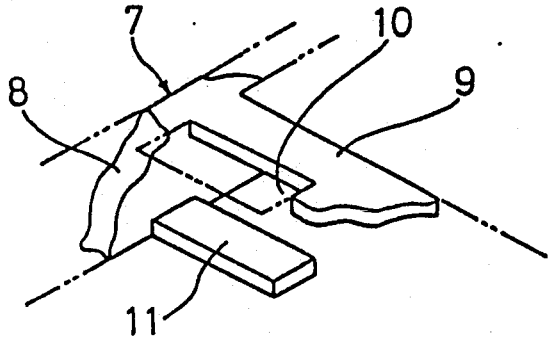
Fig. 8 (Prior Art)
FIG. 8 is an enlarged perspective view showing a principal part of the arc extinguishing chamber cover in FIG. 7.
Figure 9:
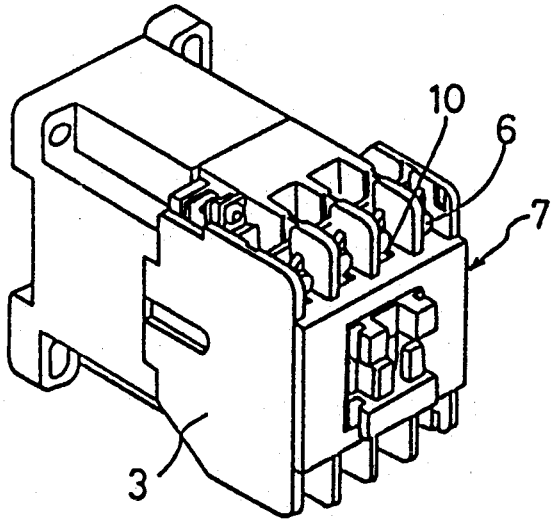
Fig. 9 (Prior Art)
FIG. 9 is a perspective view showing an appearance of the electromagnetic contactor in FIG. 7.

FIGS. 5 and 6 show a third embodiment. In the third embodiment, the foreign matter preventing wall 11 includes an inclined surface 11*a* on the side opposite to the arc extinguishing partition 9, and the inclined surface 11*a* descends toward the ceiling wall 8 of the arc extinguishing chamber cover 7. The ceiling wall 8 includes a through hole adjacent to the lower edge of the inclined surface 11*a*.

With a construction as described above, foreign matters trapped in the hollow portion 13 slide down along the inclined surface 11*a* because of vibrations of the electromagnetic contactor, and discharged to the outside from the through hole 14, so that there is a least possibility of foreign matters entering into the electromagnetic contactor beyond the ribs 12.

According to the present invention, since the foreign matter preventing wall is formed with ribs therearound, in an embankment shape on the side facing the arc extinguishing partition, foreign matters having entered through the gas discharging opening can be prevented from slipping off the foreign matter preventing wall, so that the foreign matters can be prevented from entering into the electromagnetic contactor.

What is claimed is:

1. A dust preventing device for an electromagnetic contractor, comprising:

a ceiling wall adapted to be disposed above contacts, an arc extinguishing partition situated around the contacts, said arc extinguishing partition and said ceiling wall forming an arc extinguishing chamber cover, said arc extinguishing partition extending from the ceiling wall and having a gas discharging opening at a position corresponding to the contacts, and a foreign matter preventing wall extending from the ceiling wall of the arc extinguishing chamber cover to be located under the gas discharging opening, said preventing wall having a size at least equal to a size of the gas discharging opening, and ribs formed around the preventing wall to prevent foreign matters accumulated on the preventing wall from entering inside the electromagnetic contactor.

2. A dust preventing device according to claim 1, wherein the ribs except a part thereof disposed around the foreign matter preventing wall are extended to the arc extinguishing partition.

3. A dust preventing device according to claim 1, wherein the foreign matter preventing wall includes an inclined surface on a side opposite to the arc extinguishing partition, descending toward the ceiling wall, said ceiling wall having a through hole communicating with a portion of the inclined surface so that the foreign matter accumulated on the inclined surface are expelled outside the dust preventing device.

4. A dust preventing device for an electromagnetic contractor, comprising:

a ceiling wall adapted to be disposed above contacts, an arc extinguishing partition situated above and around the contracts to form an arc extinguishing chamber cover together with said ceiling wall for covering the contacts, said arc extinguishing partition extending substantially perpendicularly from the ceiling wall to cover the contact and having a gas discharging opening at a position above the contacts, and a foreign matter preventing wall extending substantially perpendicularly from the ceiling wall to be located under the gas discharging opening and above the contacts, said preventing wall having a size at least equal to a size of the gas discharging opening, and ribs situated around the preventing wall and extending toward the arc extinguishing partition to have a space between the ribs and the arc extinguishing partition so that foreign matters entering through the gas discharging opening accumulates on the preventing wall and are prevented by the ribs from falling onto the contacts.

* * * * *